United States Patent [19]

Ings

[11] Patent Number: 4,718,368

[45] Date of Patent: Jan. 12, 1988

[54] SUBMERSIBLE WATER CRAFT

[76] Inventor: Terry C. Ings, 6 Tyler Street, Joondanna, Western Australia 6060, Australia

[21] Appl. No.: 767,280

[22] PCT Filed: Oct. 17, 1984

[86] PCT No.: PCT/AU84/00209

§ 371 Date: Sep. 12, 1985

§ 102(e) Date: Sep. 12, 1985

[87] PCT Pub. No.: WO85/02157

PCT Pub. Date: May 23, 1985

[30] Foreign Application Priority Data

Nov. 11, 1983 [AU] Australia ..... PG2347

[51] Int. Cl.[4] ..... B63B 1/00

[52] U.S. Cl. ..... 114/61; 114/339

[58] Field of Search ..... 114/61, 123, 125, 312, 114/313, 314, 327, 330, 334, 337, 338, 339, 340, 66, 256

[56] References Cited

U.S. PATENT DOCUMENTS

| | | | |
|---|---|---|---|
| 1,303,508 | 5/1919 | Simpson | 114/123 |
| 4,441,445 | 4/1984 | De Weck | 114/123 |
| 4,452,166 | 6/1984 | Daniel | 114/61 |
| 4,457,248 | 7/1984 | Thurston | 114/123 |
| 4,494,472 | 1/1985 | Rougerie | 114/61 |

*Primary Examiner*—Joseph F. Peters, Jr.
*Assistant Examiner*—Jesus D. Sotelo
*Attorney, Agent, or Firm*—Harness, Dickey & Pierce

[57] ABSTRACT

A partially submersible water craft comprising a main hull and a pair of secondary hulls mounted one to each side of the main hull, an arm pivotally mounted at one end to each of the main hull and pivotally mounted at the other end to the secondary hull, drive means between the arm and the main hull and/or secondary hull to cause pivotal movement of both arms relative to the main hull and/or the secondary hull wherein said main hull is movable between a position substantially coplanar with the secondary hulls and a second position wherein said main hull is located below the secondary hulls but spaced in between the secondary hulls.

13 Claims, 5 Drawing Figures

SUBMERSIBLE WATER CRAFT

This invention relates to a partially submersible water craft.

In one form the invention resides in a partially submersible water craft comprising a main hull and a pair of secondary hulls mounted one to each side of the main hull, an arm pivotally mounted at one end to each side of the main hull and pivotally mounted at the other end to the secondary hull, drive means between the arm and the main hull and/or secondary hull to cause pivotal movement of both of the arms relative to the main hull and/or the secondary hull wherein said main hull is movable between a position substantially coplanar with the secondary hulls and a second position wherein said main hull is located below the secondary hulls but spaced in between the secondary hulls.

According to a preferred feature of the invention the arms form part of a parallelogram-like linkage between the main hull and secondary hulls.

According to a further feature the main hull has positive buoyancy.

According to a further preferred feature of the invention the main hull has an air intake and exhaust which remain in constant communication with the atmosphere.

According to a further preferred feature of the invention the air intake and exhaust is incorporated in a superstructure on the main hull, the upper portion of which is always above water level.

According to a further preferred feature of the invention the super-structure incorporates an entry hatch and bridge facilities.

According to a further preferred feature of the invention the secondary hulls accommodate drive motors for effecting propulsion of the water craft and for auxiliary services.

The invention will be more fully understood in the light of the following description of one specific embodiment. The description is made with reference to the accompanying drawings of which:

Figure 1:
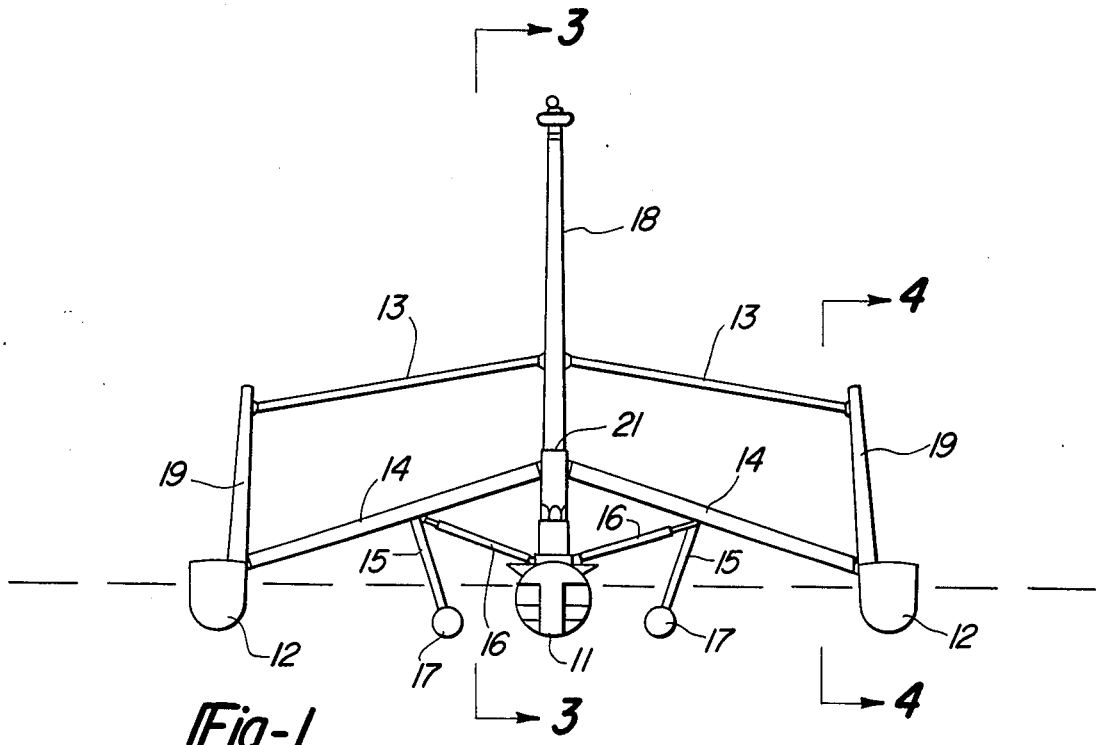
FIG. 1 is a front elevational view of the embodiment with the main hull in the first position.
Figure 2:
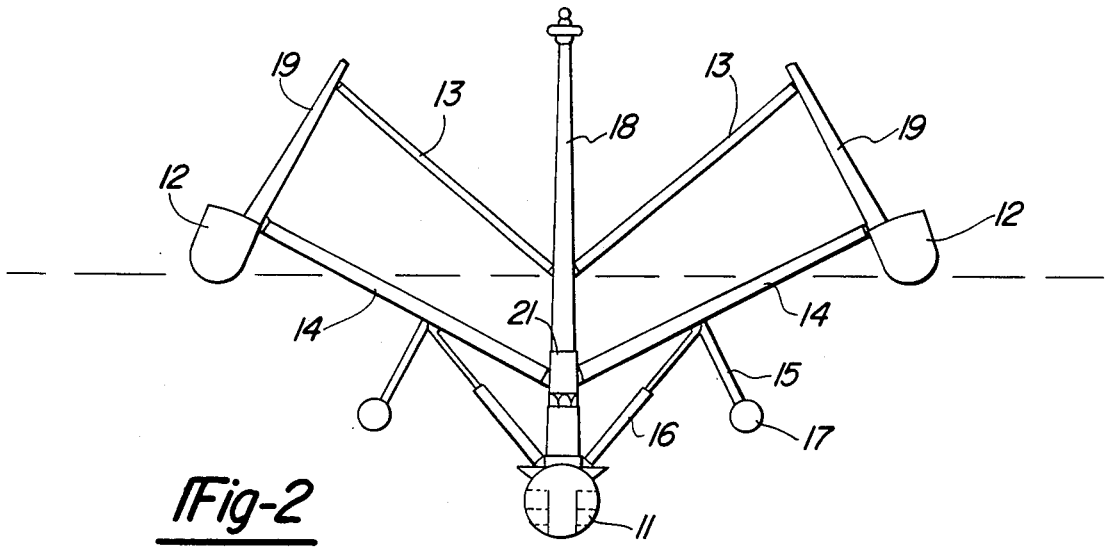
FIG. 2 is a front elevational view of the embodiment with the main hull in the second position.
Figure 3:
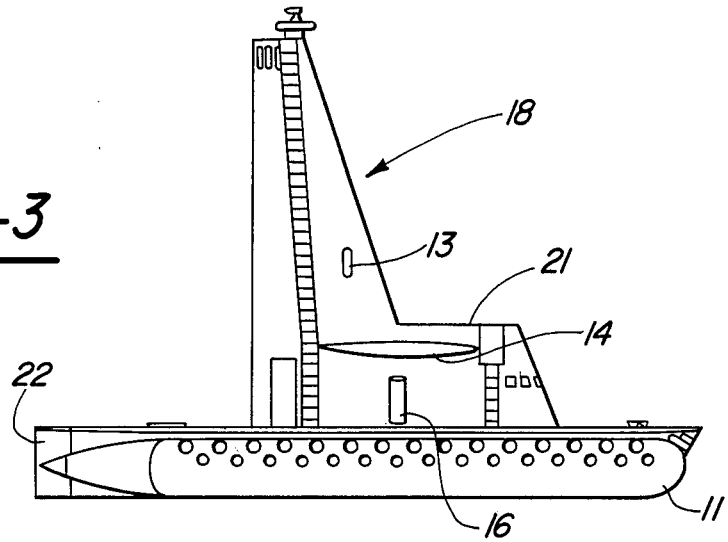
FIG. 3 is a part sectional view of the embodiment along line 3—3 of FIG. 1.
Figure 4:
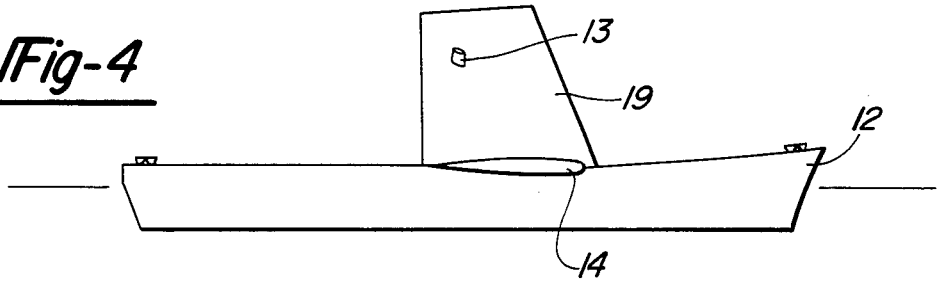
FIG. 4 is a sectional view of the embodiment along line 4—4 of FIG. 1.
Figure 5:
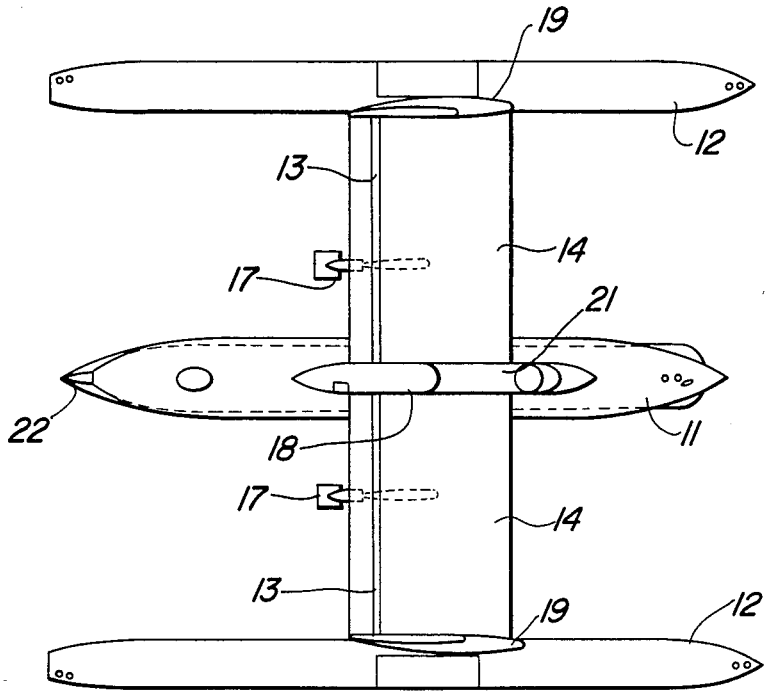
FIG. 5 is a plan view of the embodiment.

As shown in the drawings the embodiment comprises a water craft consisting of a central main hull 11 and a secondary hull 12 located to each side of the main hull 11. The main hull is formed with an upstanding superstructure 18 and each secondary hull 12 is connected to the main hull by means of an outrigger arm 14 pivotally mounted to both the secondary hull 12 and to the main hull 11. Each outrigger arm is associated with a secondary arm 13 mounted in parallel relationship with the outrigger arm 13 and pivotally connected to the superstructure 18 of the main hull 11 and an upstanding super-structure 19 of the secondary hulls 12 whereby the outrigger arm 14 and secondary arm 13 provide a parallelogram type linkage between the main hull and the secondary hull 12. A hydraulic ram 16 is mounted between the main hull 11 and each outrigger arm 14 whereby upon retraction or extension of the arm 16 the outrigger 13 is pivoted on the main hull to vary the disposition of the main hull to the secondary hulls 12. On retraction of the ram 16 the main hull is brought to a first position at which it is located substantially coplanar with and between the secondary hulls 12. On extension of the hydraulic ram 16 the main hull is moved to a position below the level of the secondary hulls 12 but between the secondary hulls. Due to the nature of the parallelogram-like interconnection between the main hull 11 and the secondary hull 13 the main hull maintains a substantially constant attitude to the vertical.

The outrigger arms each support propulsion pods 17 which incorporate drive propellers or the like drive means. The propulsion pods 17 are supported from the outrigger arms 14 by downwardly depending struts 15 such that when the main hull 11 is in its first position the propulsion pods 17 remain submerged. It is preferred that the propulsion pods have hydraulic motors as their drive means which receive a supply of hydraulic fluid through lines from a pump driven from a motor within the adjacent second hull 12. In addition each of the secondary hulls 12 accommodate such auxilliary power sources as may be required by the water craft.

The upstanding super-structure 19 of each secondary hull 12 is supplied with air ducts to effect air movement in and out of the secondary hulls 12 and the exhaust for the drive motors carried within the secondary hulls 12.

The super-structure 18 of the main hull 11 has an air inlet and exhaust connected to the interior of the main hull which are associated with suitable fans to effect an air flow in and out of the main hull 11. In addition the super-structure has a loading platform 21 whereby the crew and passengers may enter and leave the main hull 11 when on the surface and provide open bridge facilities. The interior of the super-structure also provides enclosed bridge facilities.

The rear of the main hull 11 supports a rudder 22 to effect steering of the craft and if desired each of the secondary hulls may also incorporate a rudder to further facilitate steering.

As a result of the embodiment a water craft is provided having a main passenger supporting portion in the main hull 11 which can be readily submerged and raised to the surface by merely pivoting the outrigger arms 14 and secondary arms 13 by means of the hydraulic cylinders 16. The degree of submersion of the main hull may be varied by varying the inclination of the outrigger arms 14 and secondary arms 13 to the horizontal plain. In the light of such, a craft is provided which can be used for sight-seeing, exploration and/or for the inspection of under water installations at relatively low depths. Due to the presence of the air duct extending between the atmosphere and the main hull at all times it is not necessary to pressurise the main hull. In addition due the positive buoyancy of the main hull the water craft will remain buoyant and in constant communication with the atmosphere, in the event of the failure of any one of the drive systems associated with the craft.

It should be appreciated that the scope of the present invention need not be limited to the particular scope of the embodiment described above.

The claims defining the invention are as follows.

I claim:

1. A partially submersible water craft comprising a main hull having an upstanding superstructure and a pair of secondary hulls each positioned on a respective side of said main hull and each having an upstanding mast, and a parallelogram-like linkage system connecting each of said secondary hulls to the respective sides of said main hull, said parallelogram linkage system comprising a pair of first rigid links pivotally connected at one end to said main hull and pivotally connected at their other ends to the respective secondary hull and a pair of second rigid links pivotally connected at one opposite end thereof directly to said main hull mast and the mast of the respective secondary hull, said second links lying above said first links in all operating positions of said water craft, a drive means for effecting pivotal movement of said parallelogram linkage system relative to the main hull for moving said main hull between a first position substantially level with said secondary hulls and a second position below said secondary hulls when said secondary hulls are immersed in a body of water.

2. A partially submersible water craft as claimed in claim 1 wherein said main hull has positive buoyancy.

3. A partially submersible water craft as claimed at claim 1 wherein said main hull has an air intake and an exhaust which remain in constant communication with the atmosphere.

4. A partially submersible water craft as claimed at claim 3 wherein the air intake and exhaust are incorporated in the super-structure on the main hull, and the upper portion of the super-structure is always above water level.

5. A partially submersible water craft as claimed at claim 4 wherein the super-structure incorporates an entry hatch and bridge facilities.

6. A partially submersible water craft as claimed at claim 1 wherein the secondary hulls accommodate drive means for effecting propulsion of the water craft and auxiliary services.

7. A partially submersible water craft as claimed in claim 1 further including power means carried by the water craft on an element other than the main hull for driving the water craft.

8. A partially submersible water craft as claimed in claim 7 wherein the power means includes a pair of propulsion means each carried by the parallelogram-like linkage system on a respective side of the main hull.

9. A partially submersible water craft as claimed in claim 8 further including drive means for driving the propulsion means, said drive means being carried by the secondary hulls.

10. A partially submersible water craft as claimed in claim 1 wherein the power means includes a pair of propulsion means each suspended by a respective link of the parallelogram-linkage system between its ends.

11. A partially submersible water craft as claimed in claim 10 further including drive means for driving the propulsion means, said drive means being carried by the secondary hulls.

12. A partially submersible water craft comprising a main hull and a pair of secondary hulls each positioned on a respective side of said main hull, linkage means connecting each of said secondary hulls to a respective side of said main hull, drive means for effecting pivotal movement of said linkage means relative to said main hull for moving said main hull between a first position substantially level with said secondary hulls and a second position below said secondary hulls, and power means for driving said water craft carried by an element thereof other than said main hull, said power means comprising a pair of propulsion means each carried by a respective one of said linkage means and positioned between said main hull and the respective secondary hull.

13. A partially submersible water craft as claimed in claim 12 further including drive means for driving the propulsion means, said drive means being carried by the secondary hulls.

* * * * *